US005481271A

United States Patent [19]

Hai et al.

[11] Patent Number: 5,481,271

[45] Date of Patent: Jan. 2, 1996

[54] TWO-WAVE ANTENNA FOR TELEPHONES USED IN VEHICLES

[75] Inventors: Xu Hai; Yoshimi Egashira, both of Kanagawa, Japan

[73] Assignee: Harada Kogyo Kabushiki Kaisha, Tokyo, Japan

[21] Appl. No.: 218,097

[22] Filed: Mar. 25, 1994

[51] Int. Cl.[6] ..... H01Q 9/20

[52] U.S. Cl. ..... 343/749; 343/827

[58] Field of Search ..... 343/715, 722, 343/900, 749, 826, 827; H01Q 1/32, 9/20

[56] References Cited

U.S. PATENT DOCUMENTS 4,721,965 1/1988 Elliott ..... 343/715

4,857,939 8/1989 Shimazaki ..... 343/715

*Primary Examiner*—Michael C. Wimer

*Attorney, Agent, or Firm*—Koda and Androlia

[57] ABSTRACT

A two-wave antenna for telephones used in vehicles which includes two radiating elements in which one end of each of the two radiating elements is respectively connected to one end of a single phase coil and the effective radiating lengths of the two radiating elements are respectively ½ $\lambda_1$ to ⅝ $\lambda_1$ and an electrical length of the phase coil is 3/2 $\lambda_1$ to 5/4 $\lambda_1$ so that currents of the same phase and two frequency bands are carried in the two radiating elements and wherein $\lambda_1$ is the wavelength of the first band.

1 Claim, 3 Drawing Sheets

G=3.35 dBi

G=3.19 dBi

TWO-WAVE ANTENNA FOR TELEPHONES USED IN VEHICLES

BACKGROUND OF THE INVENTION

1. Field of Industrial Utilization

The present invention relates to a two-wave antenna for telephones used in vehicles that includes an antenna element made of two radiating elements connected to both ends of a single phase coil so as to transmit and receive a first wave in the 1.5 GHz band and a second wave in the 0.9 GHz band.

2. Prior Art

FIG. 3 shows an electrical structure of the antenna element used in a conventional two-wave antenna for automobile telephones. In this antenna element 30, two radiating elements 31 and 32 are connected to both ends of a single induction element 33, so that transmission and reception of a first wave in the 440 MHz band and a second wave in the 140 MHz band are accomplished. The effective radiating lengths of the two radiating elements 31 and 32 and the electrical length of the induction element 33 are respectively set at ½ λa where λa is the wavelength of the first wave. The induction element 33 of this antenna element 30 acts as a phase coil with respect to the first wave in the 440 MHz band and also acts as a loading coil with respect to the second wave in the 140 MHz band. Thus, the current distribution of the first wave in the 440 MHz band is indicated by Ia, and the current distribution of the second wave in the 140 MHz band is indicated by Ib.

In this case, the ratio of the frequency of the first wave to the frequency of the second wave, which is "440/140", is roughly equal to 3. Accordingly, an antenna element of prescribed dimensions made for use in the 440 MHz band can be used "as is" as an antenna element for the 140 MHz band.

Recently, however, there has been a demand for two-wave antennas for telephones used in vehicles which are capable of transmission and reception using a first wave in the 1.5 GHz band and a second wave in the 0.9 GHz band. In response to this demand, there is an antenna element 40 which is obtained by interposing an induction element 43 as a phase coil between two radiating elements 41 and 42 as shown, for example, in FIG. 3(*b*) so that transmission and reception of a first wave in the 1.5 GHz band can be accomplished. In this antenna element, the current distribution caused by the first wave in the 1.5 GHz band is as indicated by Ic, and good transmission and reception characteristics are obtained. However, the current distribution caused by the second wave in the 0.9 GHz band is indicated by Id, and a so-called "splitting" occurs in the radiation pattern. As a result, good transmission and reception characteristics are not obtained.

An antenna for solving this problem has been proposed, and in this antenna a parasitic antenna element is used. This antenna element is installed next to a dipole antenna so that the parasitic antenna element transmits and receives one wave and the dipole antenna element transmits and receives the other wave. However, this antenna has a complicated structure and lacks reliability. In addition, it has a drawback of high cost.

SUMMARY OF THE INVENTION

The object of the present invention is to provide a two-wave antenna for telephones used in vehicles which can efficiently transmit and receive both a first wave in the 1.5 GHz band and a second wave in the 0.9 GHz band in a simple structure. In addition, it can be manufactured inexpensively.

In the present invention, the following structure is adopted in order to solve the problems and achieve the object: More specifically, the two-wave antenna for telephones used in vehicles of the present invention includes an antenna element that is made of a single phase coil and two radiating elements which are connected to both ends of the single phase coil, and the effective radiating lengths of the radiating elements are respectively set at ½ λA to ⅝ λA and the electrical length of the phase coil is set at ⅜ λA to ⅝ λA so that currents of the same phase in two frequency bands, caused by a first wave in the 1.5 GHz band and a second wave in the 0.9 GHz band, are carried in the radiating elements. In the above, λA is the wavelength of the first wave.

As a result of the structure described above, the present invention is able to function in the following manner: Currents of the same phase in both frequency bands, that are caused by a first wave in the 1.5 GHz band and a second wave in the 0.9 GHz band, are able to be carried in the two radiating elements. Accordingly, radiation is performed effectively. Thus, a two-wave antenna that includes a single antenna element which has a satisfactory radiation pattern and gain for both of the two waves is obtained.

DETAILED DESCRIPTION OF THE INVENTION

FIG. 1(*a*) shows the electrical structure of an antenna element 10 used in a two-wave antenna for telephones used in vehicles of a first embodiment of the present invention. In this antenna element 10, as shown in FIG. 1(*a*), two radiating elements 11 and 12 are connected to both ends of a single phase coil 13 so that transmission and reception of a first wave in the 1.5 GHz band and a second wave in the 0.9 GHz band are accomplished.

In this antenna element, the effective radiating lengths of the two radiating elements 11 and 12 are set at ½ λA and 3/10 λB, respectively, and the electrical length of the phase coil 13 is set at ⅜ λA and 9/10 λB, respectively. In these settings, A is the wavelength of the first wave in the 1.5 GHz band and λB is the wavelength of the second wave in the 0.9 GHz band.

Accordingly, as shown in FIG. 1(*a*), the current distribution caused by the first wave in the 1.5 GHz band is as indicated by IA, and the radiation current is as indicated by the shaded areas M. Furthermore, the current distribution caused by the second wave in the 0.9 GHz band is as indicated by IB, and the radiation current is as indicated by the shaded areas N.

In this embodiment, the radiation current M caused by the first wave in the 1.5 GHz band is accurately carried at ½ λA in each of the radiating elements 11 and 12; and the radiation current N caused by the second wave in the 0.9 GHz band is carried at a slightly shorter width of 3/10 λB in each of the radiating elements 11 and 12. As seen from the above, the currents of the same phase in both frequency bands are carried in the two radiating elements 11 and 12. Therefore, the radiation is effectively performed. The single antenna element 10 has a satisfactory radiation pattern and gain for both waves.

FIG. 1(*b*) illustrates the electrical structure of an antenna element 20 for a two-wave antenna for telephones used in vehicles according to the second embodiment of the present invention. In this antenna element 20, as shown in FIG. 1(*b*), two radiating elements 21 and 22 are connected to both ends of a single phase coil 23 so that transmission and reception of a first wave in the 1.5 GHz band and a second wave in the 0.9 GHz band are accomplished.

The effective radiating lengths of the two radiating elements 21 and 22 are set at ⅝ λA and ⅜ λB, respectively, and the electrical length of the phase coil 23 is set at ⅝ λA and ¾ λB, respectively.

Thus, as shown in FIG. 1(*b*), the current distribution caused by the first wave in the 1.5 GHz band is as indicated by IA, and the radiation current is as indicated by the shaded area V. On the other hand, the current distribution caused by the second wave in the 0.9 GHz band is as indicated by IB, and the radiation current is as indicated by the shaded area W.

According to the second embodiment, the radiation current V caused by the first wave in the 1.5 GHz band is carried at ⅝ λA in each of the radiating elements 11 and 12 in a configuration that includes a slight inverted-phase current component. On the other hand, the radiation current W caused by the second wave in the 0.9 GHz band is carried at ⅜ λB, which is a slightly expanded width compared to the width shown in the first embodiment described above, with respect to each of the radiating elements 11 and 12. As seen from the above, in the second embodiment as well, currents of the same phase in both frequency bands are carried in the two radiating elements 11 and 12, so that radiation is effectively performed. Thus, the single antenna element 20 has a satisfactory radiation pattern and gain for both waves.

Incidentally, the electrical length of the coil 13 or 23 is set at ⅜ λA to ⅝ λA in the first and second embodiments, respectively. This means that the winding is done an extra 2.5 to 3 times compared to a case where the electrical length of the coil is set at ½ λc as in the conventional example shown in FIG. 3(*b*). If the number of windings is thus increased, there is a danger that the coils 13 and 23 act as a so-called "trap coil". For this reason, the winding pitch, etc., of the coils 13 and 23 of the first and second embodiments is adjusted so that the coils 13 and 23 do not act as trap coils. In other words, it is designed so that two waves are appropriately carried in the two radiating elements which are provided at upper and lower ends of the coils 13 and 23. Thus, the antenna can obtain a required antenna gain.

FIGS. 2(*a*) and 2(*b*) are diagrams which show the results of measurement of the ratio of the peak value P1 of the current distribution waveform carried in the upper radiating element 11 to the peak value P2 of the current distribution waveform carried in the lower radiating element 12. This measurement is performed in order to check whether or not the phase coil 13 of the antenna element 10 of the first embodiment operates in a normal fashion as a phase coil. As a result of these measurements, it was found that this ratio was 50 to 60% for the first wave in the 1.5 GHz band, and 70% for the second wave in the 0.9 GHz band. The "trap coil" phenomena occurs When the ratio of peak value is 25% or less. Thus, due to the fact that the peak-value ratio of the coil 13 of the first embodiment greatly exceeds 25%, it is confirmed that the coil 13 operates normally as a phase coil.

FIGS. 2(*c*) and 2(*d*) are diagrams which show the results of measurement of radiation patterns PA and PB which indicate the directivity and gain of the antenna element 10 of the first embodiment. As seen from these FIGS., the antenna element 10 has a good directivity. It is confirmed that a gain of 3.35 dBi is obtained for the first wave in the 1.5 GHz band and that a gain of 3.19 dBi is obtained for the second wave in the 0.9 GHz band.

No measurement results are shown here for the antenna element 20 of the second embodiment. However, it can be predicted from the conditions of the radiation currents V and W of the antenna element 20 that the measurement results obtained from the antenna element 20 will be superior to those obtained for the antenna element 10 of the first embodiment.

The present invention is not limited to the embodiments described above. It goes without saying that various modifications are available within the spirit of the present invention.

According to the present invention, the antenna includes a single antenna element in which the effective radiating lengths of two radiating elements are respectively set at ½ λA to ⅝ λA and the electrical length of the phase coil interposed between the two radiating elements is set at ⅜ λA to ⅝ λA, so that the currents of the same phase in both frequency bands, caused by the first wave in the 1.5 GHz band and the second wave in the 0.9 GHz band, can be carried in the two radiating elements. As described above, λA is the wavelength of the first wave. Accordingly, a two-wave antenna for telephones used in vehicles which can efficiently transmit and receive the waves in the 1.5 GHz band and in the 0.9 GHz band is obtained, and the antenna is simple in structure and manufactured inexpensively.

We claim:

1. A two-frequency band antenna for telephones used in vehicles comprising two radiating elements in which an end of each of said two radiating elements is respectively connected to one end of a single phase coil, and wherein effective radiating lengths of said two radiating elements are respectively ½ $\lambda_1$ to ⅝ $\lambda_1$ and an electrical length of said phase coil is ⅜ $\lambda_1$ to ⅝ $\lambda_1$ so that currents of same phase in two frequency bands comprising a first frequency band in the 1.5 GHz band and a second frequency band in the 0.9 GHz band are carried in said two radiating elements, said $\lambda_1$ being a wavelength of said first frequency band.

* * * * *

UNITED STATES PATENT AND TRADEMARK OFFICE

CERTIFICATE OF CORRECTION

PATENT NO. : 5,481,271
DATED : January 2, 1996
INVENTOR(S) : Xu Hai and Yoshimi Egashira It is certified that error appears in the above-indentified patent and that said Letters Patent is hereby corrected as shown below:

Column 2, after line 24, insert:

--BRIEF DESCRIPTION OF THE DRAWINGS

Figure 1 (b) is a diagram which illustrates the structure of an antenna element used in a two-wave antenna for telephones for vehicles according to a second embodiment of the present invention;

UNITED STATES PATENT AND TRADEMARK OFFICE

CERTIFICATE OF CORRECTION

PATENT NO. : 5,481,271 Page 2 of 2

DATED : January 2, 1996

INVENTOR(S) : Xu Hai and Yoshimi Egashira

Figure 1A:
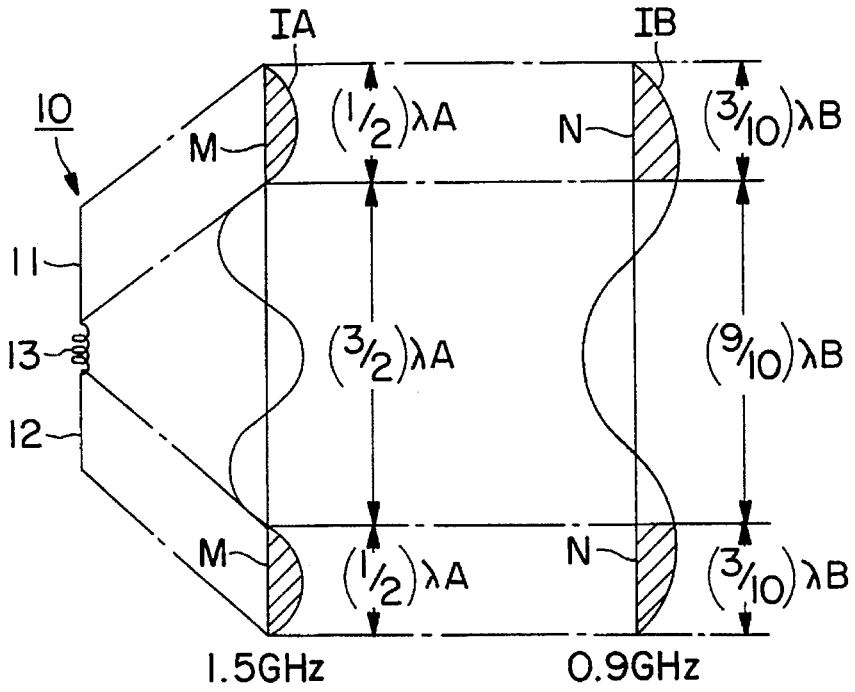
Figure 1 (a) is a diagram which illustrates the structure of the antenna used in a two-wave antenna for telephones for vehicles according to a first embodiment of the present invention.
Figure 1B:
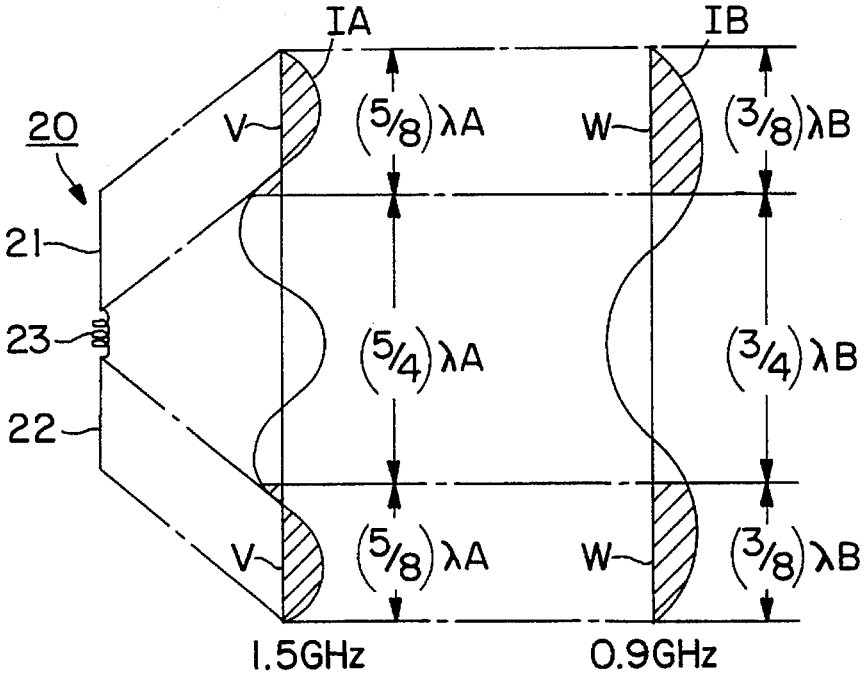
Figure 2A:
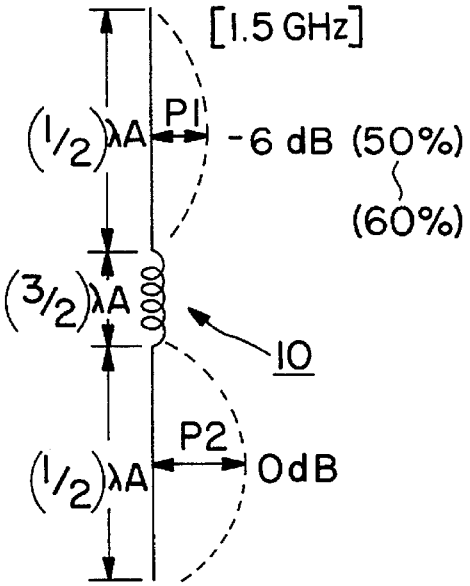
Figure 2B:
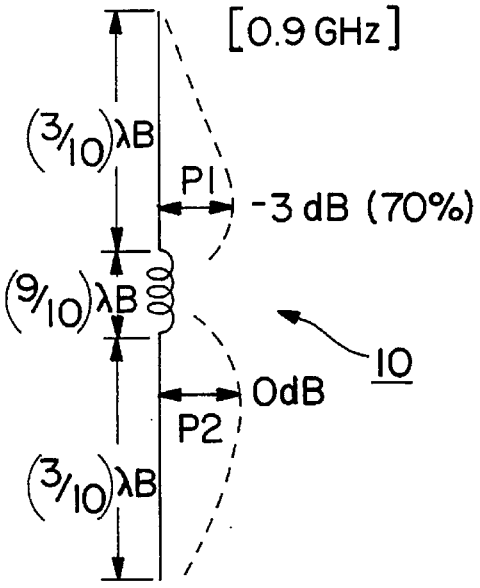
Figure 2C:
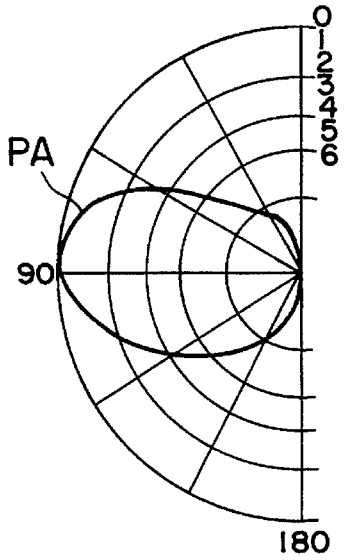
Figure 2D:
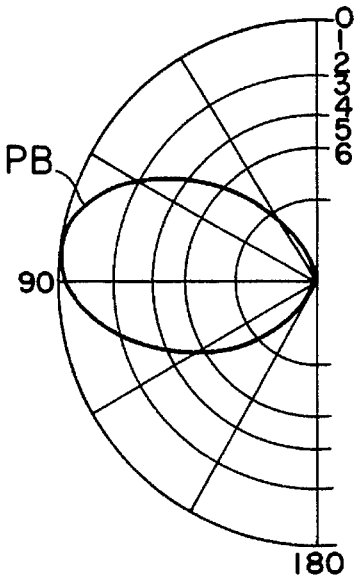
Figure 3A:
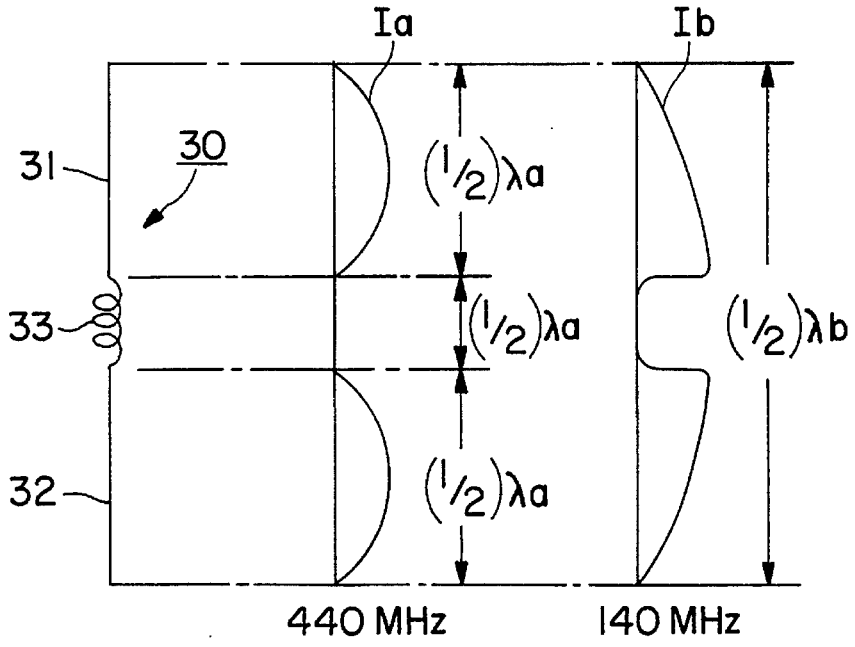
FIG. 3(a) PRIOR ART
Figure 3B:
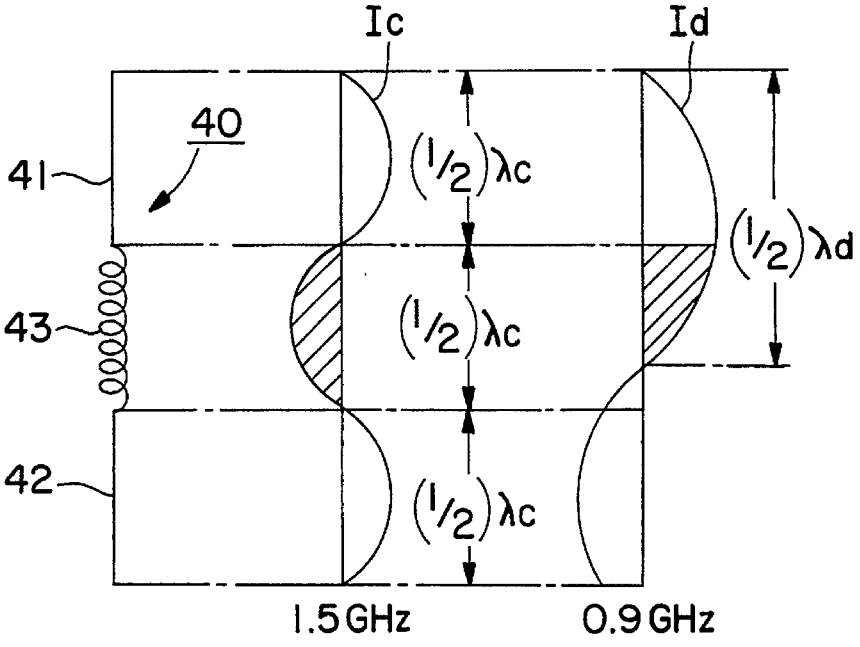
FIG. 3(b) PRIOR ART

It is certified that error appears in the above-indentified patent and that said Letters Patent is hereby corrected as shown below:

Figures 2 (a) through 2 (d) are diagrams illustrating the results of measurements of antenna element characteristics of two-wave antennas for telephones used in vehicles according to the first embodiment of the present invention; and Figures 3 (a) and 3 (b) are diagrams showing the structures of antenna elements used in conventional two-wave antennas for telephones used in vehicles.--

Signed and Sealed this

Ninth Day of April, 1996

Bruce Lehman

*Attest:*

BRUCE LEHMAN

*Attesting Officer*

*Commissioner of Patents and Trademarks*